US009639021B2

(12) United States Patent
Matsudaira et al.

(10) Patent No.: US 9,639,021 B2
(45) Date of Patent: May 2, 2017

(54) IMAGE FORMING SYSTEM, IMAGE FORMING METHOD, AND CHARGE ADJUSTING APPARATUS

(71) Applicant: KONICA MINOLTA, INC., Chiyoda-ku, Tokyo (JP)

(72) Inventors: Sachie Matsudaira, Hachioji (JP); Satoshi Nishida, Saitama (JP); Junichi Hamada, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/980,800

(22) Filed: Dec. 28, 2015

(65) Prior Publication Data

US 2016/0187803 A1 Jun. 30, 2016

(30) Foreign Application Priority Data

Dec. 25, 2014 (JP) ..... 2014-263486

(51) Int. Cl.
*G03G 15/20* (2006.01)
*G03G 15/02* (2006.01)
*G03G 15/00* (2006.01)

(52) U.S. Cl.
CPC ..... *G03G 15/0266* (2013.01); *G03G 15/6573* (2013.01); *G03G 2215/00649* (2013.01); *G03G 2215/00654* (2013.01)

(58) Field of Classification Search
CPC ..... G03G 15/6573; G03G 2215/00654; B65H 2301/5133
(Continued)

(56) References Cited

U.S. PATENT DOCUMENTS 3,865,480 A * 2/1975 Swanberg ..... B65H 45/1015 271/207
5,121,285 A * 6/1992 McClure ..... G03G 15/6591 361/212
(Continued)

FOREIGN PATENT DOCUMENTS

JP H10181969 A 7/1998
JP 2004010240 A 1/2004
(Continued)

OTHER PUBLICATIONS

Japanese Notification of Reasons for Refusal corresponding to Patent Application No. 2014-263486; Dated: Dec. 20, 2016, with English translation.

*Primary Examiner* — David Gray
*Assistant Examiner* — Tyler Hardman
(74) *Attorney, Agent, or Firm* — Cantor Colburn LLP

(57) ABSTRACT

The image forming system having an image forming apparatus and a charge adjusting apparatus has a decision unit that decides an amount of charge to be applied to a recording sheet from coverages of toner images of both surfaces of the recording sheet, the image forming apparatus has a fixing unit that heats and presses a recording sheet to which a toner image is transferred, thereby fixing the toner image to the recording sheet, and the charge adjusting apparatus has a voltage applying unit that applies a voltage to the recording sheet to which the toner image is fixed by the fixing unit, thereby applying charge with the amount decided by the decision unit to the recording sheet.

24 Claims, 9 Drawing Sheets

(58) Field of Classification Search
USPC ..... 399/341; 271/208
See application file for complete search history.

(56) References Cited

U.S. PATENT DOCUMENTS

| | | | | |
|---|---|---|---|---|
| 8,032,040 | B2 * | 10/2011 | Lee | G03G 15/1695 399/45 |
| 8,682,220 | B2 * | 3/2014 | Miyaji | G03G 21/08 399/128 |
| 2004/0091279 | A1 * | 5/2004 | Izawa | G03G 15/2028 399/67 |
| 2007/0189816 | A1 * | 8/2007 | Schmidt | G03G 15/6573 399/315 |
| 2007/0258737 | A1 * | 11/2007 | Ogiyama | G03G 15/1675 399/315 |
| 2009/0060618 | A1 * | 3/2009 | Fujikura | B65H 43/00 399/407 |
| 2012/0020715 | A1 * | 1/2012 | Takahashi | G03G 15/6538 399/407 |
| 2012/0099911 | A1 * | 4/2012 | Zaretsky | G03G 15/6573 399/406 |
| 2015/0125173 | A1 * | 5/2015 | Matsumoto | G03G 15/234 399/82 |

FOREIGN PATENT DOCUMENTS

| | | | |
|---|---|---|---|
| JP | 2006195268 | A | 7/2006 |
| JP | 2009196774 | A | 9/2009 |
| JP | 2009276463 | A | 11/2009 |
| JP | 2013227088 | A | 11/2013 |

* cited by examiner

After passing through voltage applying unit 80 | Charge applying amount | After fixing first surface: solid/second surface: solid first surface: solid/second surface: white background first surface: white background/second surface: solid

IMAGE FORMING SYSTEM, IMAGE FORMING METHOD, AND CHARGE ADJUSTING APPARATUS

CROSS-REFERENCE TO RELATED APPLICATION

This application is based on Japanese Patent Application No. 2014-263486 filed on Dec. 25, 2014, the contents of which are incorporated herein by reference.

BACKGROUND

1. Technical Field

The present invention relates to an image forming system, an image forming method, and a charge adjusting apparatus.

2. Description of Related Arts

When papers with images formed by an image forming apparatus are stacked in a post-processing apparatus or a stacker apparatus, the papers may adhere to one another by electrostatic force among them.

In this regard, Japanese Unexamined Patent Application Publication No. H10-181969 (Patent Literature 1) discloses a technology of performing static elimination of a paper with a formed image by performing corona discharge on the paper. Furthermore, Japanese Unexamined Patent Application Publication No. 2004-10240 (Patent Literature 2) discloses a technology in which a plurality of static eliminating brushes are arranged on a paper conveyance path and static elimination of a paper is repeatedly performed.

However, in the technologies disclosed in Patent Literature 1 and 2, it is not possible to sufficiently eliminate charge accumulated in a toner image on a paper. Accordingly, although static elimination has been performed using the technologies disclosed in Patent Literature 1 and 2, electrostatic force among papers does not disappear and thus the problem that the papers adhere to one another is not still solved.

SUMMARY

The present invention has been accomplished in view of the above problem. Accordingly, objectives of the present invention are to provide an image forming system, an image forming method, and a charge adjusting apparatus, by which it is possible to reliably prevent recording sheets such as papers from adhering to one another by electrostatic force.

In order to achieve at least one of the aforementioned objectives, an image forming system, reflecting one aspect of the present invention, is an image forming system having an image forming apparatus and a charge adjusting apparatus, and includes a decision unit configured to decide an amount of charge to be applied to a recording sheet from coverages of toner images of both surfaces of the recording sheet, wherein the image forming apparatus includes a fixing unit configured to heat and press a recording sheet to which a toner image is transferred, thereby fixing the toner image to the recording sheet, and the charge adjusting apparatus includes a voltage applying unit configured to apply a voltage to the recording sheet to which the toner image is fixed by the fixing unit, thereby applying charge with the amount decided by the decision unit to the recording sheet.

In the aforementioned image forming system, preferably, one recording sheet with a fixed toner image overlaps with another recording sheet with a fixed toner image, and the decision unit decides an amount of charge to be applied to the one recording sheet from coverages of both surfaces of the one recording sheet and a coverage of a surface of the another recording sheet, which faces the one recording sheet.

In the aforementioned image forming system, preferably, the decision unit decides the amount of charge to be applied to the one recording sheet from the coverages of both surfaces of the one recording sheet, the coverage of the facing surface of the another recording sheet, and an amount of charge to be applied to the another recording sheet by the voltage applying unit.

In the aforementioned image forming system, preferably, the voltage applying unit applies the voltage subjected to constant-current control to the recording sheet, and the decision unit decides a current value of the constant-current control as the amount of charge to be applied to the recording sheet.

In the aforementioned image forming system, preferably, the recording sheet is conveyed in a horizontal direction, and the voltage applying unit applies the voltage to an upper surface of the recording sheet conveyed in the horizontal direction.

In the aforementioned image forming system, preferably, the amount of charge to be applied to the recording sheet is changed in response to a surrounding environment of a place where the image forming apparatus has been installed.

In the aforementioned image forming system, preferably, the amount of charge to be applied to the recording sheet per unit time is changed in response to a conveyance speed of the recording sheet.

In the aforementioned image forming system, preferably, the amount of charge to be applied to the recording sheet is changed in response to a type of the recording sheet.

In the aforementioned image forming system, preferably, the amount of charge to be applied to the recording sheet is changed in response to at least one of a basis weight and a size of the recording sheet.

The objectives, features, and characteristics of this invention other than those set forth above will become apparent from the description given herein below with reference to preferred embodiments illustrated in the accompanying drawings.

DETAILED DESCRIPTION

The embodiments of this invention will be described below with reference to the accompanying drawings.

First Embodiment

Figure 1:
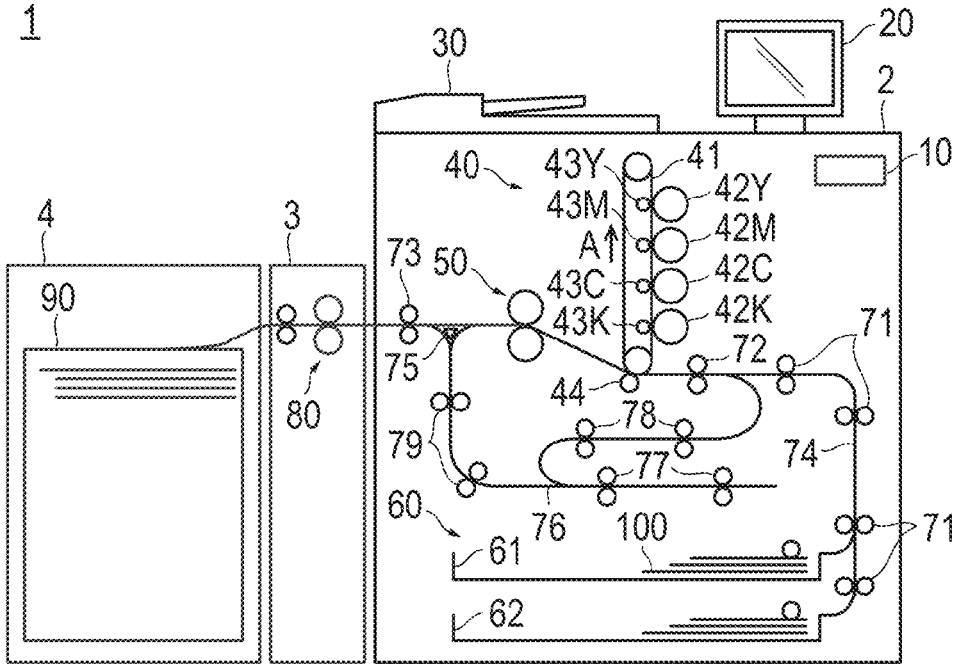
FIG. 1 is a diagram showing the schematic structure of an image forming system according to a first embodiment of the present invention.
Figure 2:
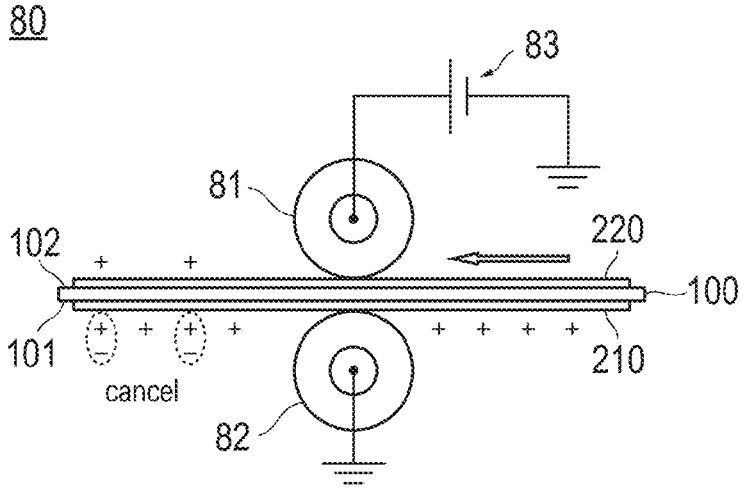
FIG. 2 is a partially enlarged diagram of FIG. 1.

FIG. 1 is a diagram showing the schematic structure of an image forming system 1 according to a first embodiment of the present invention, and FIG. 2 is a partially enlarged diagram of FIG. 1.

As shown in FIG. 1, the image forming system 1 includes an image forming apparatus 2 that forms an image on a paper, a charge adjusting apparatus 3 that adjusts charge of the paper with the image formed by the image forming apparatus 2, and a stacker apparatus 4 that accumulates the paper with the image formed by the image forming apparatus 2. The image forming apparatus 2, the charge adjusting apparatus 3, and the stacker apparatus 4 are sequentially connected to one another from an upstream side to a downstream side of paper conveyance. Hereinafter, the following description will be given in sequence of the image forming apparatus 2, the charge adjusting apparatus 3, and the stacker apparatus 4.

<Image Forming Apparatus>

The image forming apparatus 2 includes a control unit 10, an operating panel unit 20, an image reading unit 30, an image forming unit 40, a fixing unit 50, and a paper feeding unit 60.

The control unit 10 includes CPU (Central Processing Unit) and various memories, and performs the control of the aforementioned each unit and various calculation processes according to a program.

The operating panel unit 20 includes a touch panel, a numeric keypad, a start button, a stop button and the like, and is used for the display of various types of information and the input of various instructions. The image reading unit 30 reads an image of a document and generates image data.

The image forming unit 40 forms an image based on various pieces of data on a paper by using a well-known image creating process such as an electrophotographic process. A transfer belt 41 is arranged at a center part of the image forming unit 40. The transfer belt 41 is rotationally driven in a direction indicated by an arrow A, and a toner image formed on the surface of a photosensitive drum (not shown) is primarily transferred onto the transfer belt 41. Then, the toner image primarily transferred onto the transfer belt 41 is secondarily transferred to the paper.

At a lateral side of the transfer belt 41, four image creating units 42Y, 42M, 42C, and 42K (hereinafter, indicated by 42 by simplifying reference numerals) are arranged in sequence of yellow (Y), magenta (M), cyan (C), and black (K) colors from an upper side. Each image creating unit 42 has a photosensitive drum. Around each photosensitive drum, a charging device for uniformly charging the surface of the photosensitive drum, an exposure device for forming an electrostatic latent image corresponding to image data on the uniformly charged surface of the photosensitive drum, and a development device for developing the electrostatic latent image into a toner image are arranged.

Furthermore, primary transfer rollers 43Y, 43M, 43C, and 43K (hereinafter, indicated by 43 by simplifying reference numerals) are arranged at positions facing the photosensitive drums while interposing the transfer belt 41 between the primary transfer rollers 43Y, 43M, 43C, and 43K and the photosensitive drums. The primary transfer roller 43 electrostatically attracts the toner image formed on the surface of the photosensitive drum, and primarily transfers the toner image onto the transfer belt 41.

Below the transfer belt 41, a secondary transfer roller 44 is arranged. The secondary transfer roller 44 secondarily transfers the toner image formed on the transfer belt 41 to a conveyed paper. When the secondary transfer is performed, a high positive transfer voltage is applied to the secondary transfer roller 44, so that the negatively charged toner image is electrostatically attracted to the paper. The paper with the transferred toner image is supplied to the fixing unit 50.

The fixing unit 50 heats and presses the toner image transferred onto the paper by a fixing roller, thereby fixing the toner image to the paper. The paper with the toner image fixed by the fixing unit 50 is supplied to the charge adjusting apparatus 3.

The paper feeding unit 60 accommodates papers 100 as recording sheets to be used in printing. In the paper feeding unit 60, paper feeding cassettes 61 and 62 of a two-stage configuration are detachably arranged. The paper feeding cassettes 61 and 62, for example, accommodate plain papers and coated papers, respectively.

A paper conveyance path 74 from the paper feeding cassettes 61 and 62 to the charge adjusting apparatus 3 is provided via an intermediate conveying roller 71, a resist roller 72, the secondary transfer roller 44, the fixing unit 50, and a paper discharge roller 73.

Furthermore, above the paper feeding cassettes 61 and 62, an inversion conveyance path 76, which is branched from the paper conveyance path 74 via a switching gate 75 at the downstream side of the fixing unit 50 and merged into the paper conveyance path 74 immediately before the resist roller 72 positioned at the upstream side of the image forming unit 40 in the paper conveyance direction, is provided. At the downstream side of the inversion conveyance path 76, an ADU (Automatic Double-sided Unit) inverting roller 77 and an ADU intermediate conveying roller 78 are provided to invert the front and the back of a paper and convey the paper to the downstream side of the inversion conveyance path 76.

Furthermore, on the inversion conveyance path 76 positioned directly under the paper conveyance path 74 from the fixing unit 50 to the paper discharge roller 73, conveying and inverting rollers 79 are arranged to invert the front and the back of the paper conveyed from the fixing unit 50 and convey the paper to the paper discharge roller 73.

<Charge Adjusting Apparatus>

The charge adjusting apparatus 3 includes a voltage applying unit 80 that applies a voltage to the paper with the fixed toner image. As shown in FIG. 2, the voltage applying unit 80 is configured from first and second conductive rubber rollers 81 and 82 arranged to face each other, and a power source 83 that applies a voltage to the first and second conductive rubber rollers 81 and 82.

The first conductive rubber roller 81 is connected to the power source 83 and the second conductive rubber roller 82 is grounded. The power source 83 applies a positive voltage to the first conductive rubber roller 81. If the positive voltage is applied to the first conductive rubber roller 81, positive charge is applied to a second surface (a rear surface) 102 of the paper 100. Furthermore, negative charge with the same amount as that of the positive charge applied from the first conductive rubber roller 81 is induced to the second conductive rubber roller 82, and cancels with positive charge of a first surface (a front surface) 101 of the paper 100. The voltage applying unit 80 is constant-current controlled and applies a voltage subjected to the constant-current control with a predetermined current value to the paper 100.

<Stacker Apparatus>

The stacker apparatus 4 includes an accommodating unit 90 for loading the paper 100. In the accommodating unit 90, papers with the image formed by the image forming apparatus 2 are sequentially supplied and stacked.

In addition, the image forming apparatus 2, the charge adjusting apparatus 3, and the stacker apparatus 4 may also respectively include elements other than the aforementioned elements, or a part of the aforementioned elements may not be included.

In the image forming system 1 configured as described above, the papers with the image formed by the image forming apparatus 2 are accumulated in the stacker apparatus 4 by passing through the charge adjusting apparatus 3. At this time, in order to prevent adhesion of the papers stacked in the stacker apparatus 4, charged states of the papers are adjusted by the charge adjusting apparatus 3. Hereinafter, with reference to FIG. 3A to FIG. 5D, an operation of the charge adjusting apparatus 3 will be described in detail.

Figure 3A:
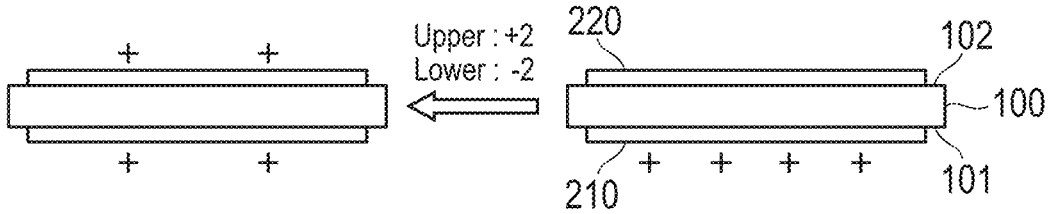
FIGS. 3A to 3C are diagrams for explaining a basic operation of a voltage applying unit.
Figure 3B:
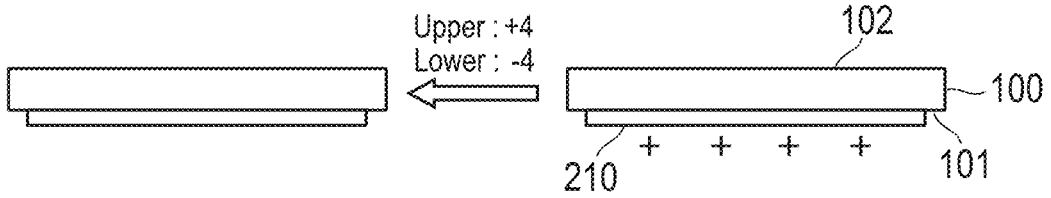
Figure 3C:
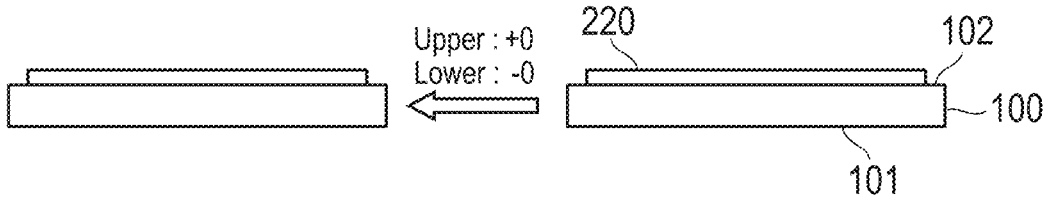

FIGS. 3A to 3C are diagrams for explaining a basic operation of the voltage applying unit 80 of the charge adjusting apparatus 3. The voltage applying unit 80 of the present embodiment applies charge with different amounts to each paper in response to the coverages (a coverage: a ratio of an area of a toner image with respect to an area of a paper) of both surfaces of a paper. The basic operation of the voltage applying unit 80 is classified into the following four operations in response to the coverages of both surfaces of the paper.

(1) Operation when Coverages of Both Surfaces of Paper are High

FIG. 3A is a diagram for explaining the operation of the voltage applying unit 80 when the coverages of both surfaces of a paper are high. The right side of FIG. 3A is a diagram showing the charged state of the paper immediately after fixing by the fixing unit 50 of the image forming apparatus 2, and the left side is a diagram showing the charged state of the paper after passing through the voltage applying unit 80. As shown in FIG. 3A, for example, when solid images have been formed on both surfaces of the paper 100, positive charge is accumulated only in a toner image 210 of the first surface 101 in the paper 100 immediately after fixing.

The voltage applying unit 80 of the present embodiment applies a positive voltage to the paper 100 immediately after the fixing, thereby applying charge with an amount corresponding to about a half of the positive charge accumulated in the toner image 210 of the first surface 101 to the paper 100. If the positive voltage is applied to the first conductive rubber roller 81 from the power source 83, positive charge is applied to the second surface 102 of the paper 100, so that the positive charge is accumulated in a toner image 220 of the second surface 102. On the other hand, negative charge with the same amount as that of the positive charge applied from the first conductive rubber roller 81 is induced to the second conductive rubber roller 82, and cancels with the positive charge in the toner image 210 of the first surface 101.

Consequently, as shown in FIG. 3A, if the paper 100 passes through the voltage applying unit 80, charge with an amount corresponding to about a half of the charge accumulated in the toner image 210 immediately after the fixing is accumulated in the toner images 210 and 220 of both surfaces of the paper 100.

(2) Operation when Coverage of First Surface of Paper is High and Coverage of Second Surface is Low FIG. 3B is a diagram for explaining the operation of the voltage applying unit 80 when the coverage of the first surface of the paper is high and the coverage of the second surface is low. The right side of FIG. 3B is a diagram showing the charged state of the paper immediately after the fixing by the fixing unit 50 of the image forming apparatus 2, and the left side is a diagram showing the charged state of the paper after passing through the voltage applying unit 80. As shown in FIG. 3B, for example, when a solid image has been formed on the first surface 101 of the paper 100 but the second surface 102 is an almost white background (a toner layer does not almost exist), positive charge is accumulated only in the toner image 210 of the first surface 101 in the paper 100 immediately after the fixing.

The voltage applying unit 80 of the present embodiment applies a positive voltage to the paper 100 immediately after the fixing, thereby applying charge with the same amount as that of the positive charge accumulated in the toner image 210 of the first surface 101 to the paper 100. If the positive voltage is applied to the first conductive rubber roller 81 from the power source 83, positive charge is applied to the second surface 102 of the paper 100. However, charge does not almost remain in the second surface 102 in which a toner layer does not almost exist. On the other hand, negative charge with the same amount as that of the positive charge applied from the first conductive rubber roller 81 is induced to the second conductive rubber roller 82, and cancels with the positive charge in the toner image 210 of the first surface 101.

Consequently, as shown in FIG. 3B, if the paper 100 passes through the voltage applying unit 80, the paper 100 enters an almost non-charged state.

(3) Operation when Coverage of First Surface of Paper is Low and Coverage of Second Surface is High FIG. 3C is a diagram for explaining the operation of the voltage applying unit 80 when the coverage of the first surface of the paper is low and the coverage of the second surface is high. The right side of FIG. 3C is a diagram showing the charged state of the paper immediately after the fixing by the fixing unit 50 of the image forming apparatus 2, and the left side is a diagram showing the charged state of the paper after passing through the voltage applying unit 80. As shown in FIG. 3C, for example, when the first surface 101 of the paper is an almost white background but a solid image has been formed on the second surface 102, the paper 100 immediately after the fixing enters an almost non-charged state. Consequently, the voltage applying unit 80 of the present embodiment applies no voltage to the paper 100 and maintains the non-charged state of the paper 100.

(4) Operation when Coverages of Both Surfaces of Paper are Low

For example, when both surfaces of the paper are almost white backgrounds, the paper 100 immediately after the fixing enters an almost non-charged state. Consequently, the voltage applying unit 80 of the present embodiment applies no voltage to the paper 100 and maintains the non-charged state of the paper 100.

As described above, the voltage applying unit 80 of the charge adjusting apparatus 3 applies charge with amounts different in each paper in response to the coverages of both surfaces of the paper 100. According to such a configuration, the charged states of two facing surfaces of papers stacked in the stacker apparatus 4 are adjusted, so that adhesion of papers due to electrostatic force is prevented. Hereinafter, with reference to FIGS. 4A to 4G, the effect of the charge adjustment process by the voltage applying unit 80 will be described in detail.

Figure 4A:
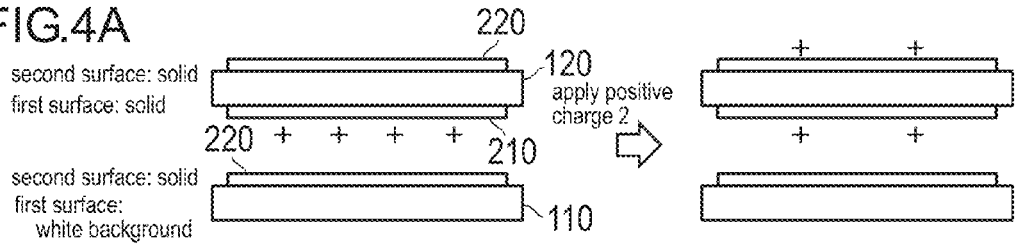
FIGS. 4A to 4G are diagrams for explaining an effect of a charge adjustment process by a voltage applying unit.
Figure 4B:
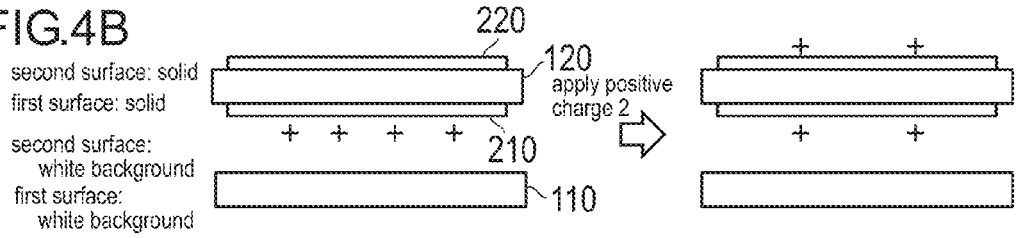
Figure 4C:
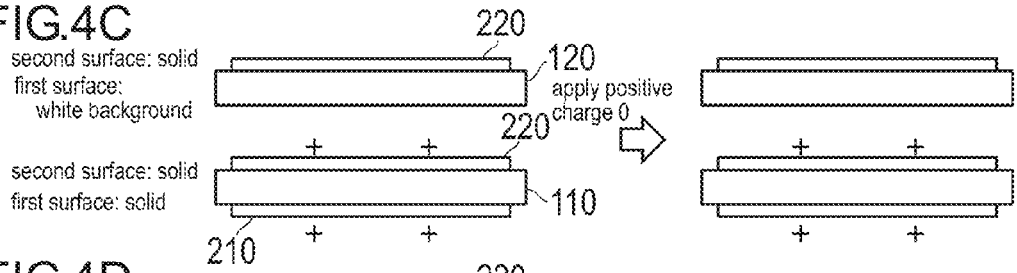
Figure 4D:
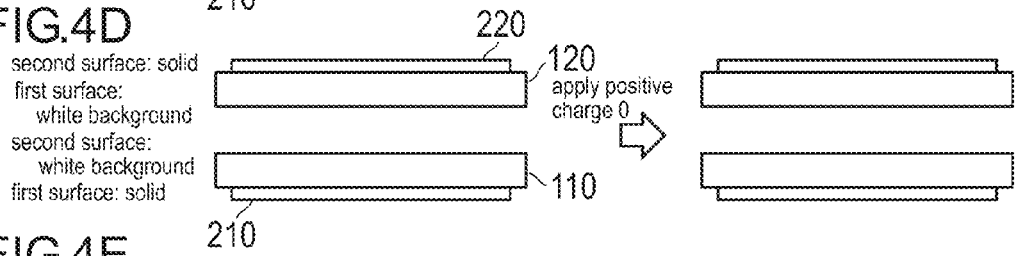
Figure 4E:
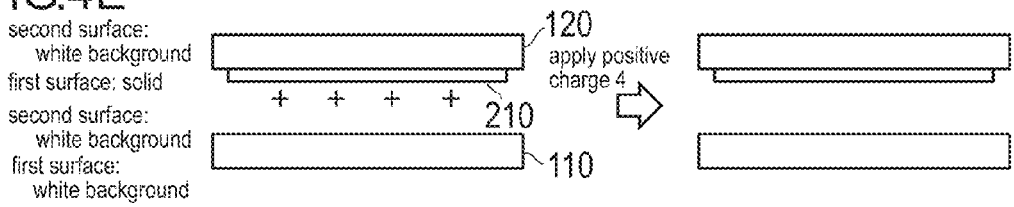
Figure 4F:
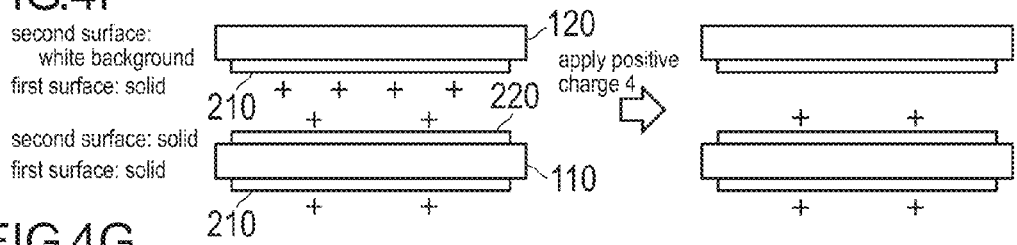
Figure 4G:
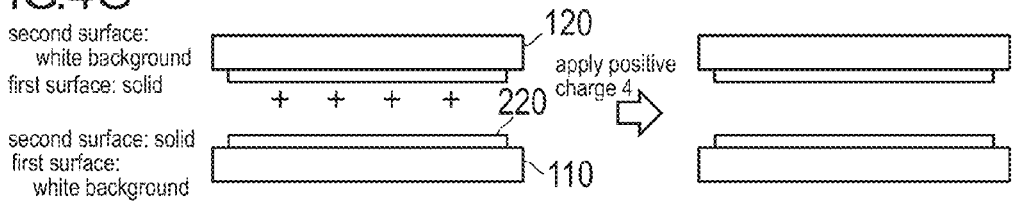

FIG. 4A is a diagram for explaining the effect of the charge adjustment process when a paper 120 with high coverages of both surfaces overlaps with a paper 110 with low coverage of a first surface and high coverage of a second surface. The right side of FIG. 4A is a diagram showing the charged states of the papers 110 and 120 after the charge adjustment process, and the left side is a diagram showing the charged states of the paper 110 after the charge adjustment process and the paper 120 before the charge adjustment process as a comparison example.

As described above, the paper 110 with the low coverage of the first surface and the high coverage of the second surface is maintained in an almost non-charged state after the charge adjustment process. On the other hand, in the paper 120 with the high coverages of both surfaces, the amount of charge accumulated in the toner image 210 of the first surface is reduced to about ½ before and after the charge adjustment process.

Consequently, according to the charge adjustment process of the present embodiment, the amount of the charge accumulated in the toner image 210 of the first surface of the paper 120 is reduced, so that electrostatic force acting between the papers 110 and 120 also becomes small. As a consequence, the papers 110 and 120 are not stuck with each other.

Furthermore, as shown in FIGS. 4B to 4G, according to the charge adjustment process of the present embodiment, for all combinations of papers with the aforementioned four pairs of coverages, the amount of charge existing on two facing surfaces of the two papers 110 and 120 is adjusted to be equal to or less than a constant amount (in FIGS. 4A to 4G, the number of charge is equal to or less than 2). Consequently, for all papers, the size of electrostatic force acting between papers is adjusted to be smaller than a constant value, so that the papers are reliably prevented from being stuck with one another. In this way, handling (for example, correction of paper misalignment) and the like of the papers in a post-process are improved.

Hereinafter, with reference to FIGS. 5A to 5D, the charged states of papers after toner image fixing will be described in detail.

As described above, in the image forming apparatus 2, when a toner image is transferred to a paper, a positive transfer voltage is applied from the rear side of the paper, so that the toner image charged to be negative is electrostatically attracted to the paper 100. Then, when the toner image charged to be negative is fixed to a paper, the charge is eliminated by heat applied by the fixing unit 50, so that the negative charge does not almost remain in the toner image fixed to the paper.

Figure 5A:
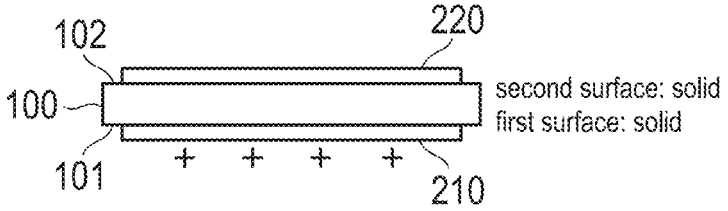
FIGS. 5A to 5D are diagrams showing a charged state of a paper after a toner image is fixed.

However, when duplex printing is performed, the negative charge does not remain in the toner image 210 of the first surface 101 of the paper 100, but positive charge is newly applied at the time of transfer of the toner image 220 of the second surface 102. Then, at the time of fixing of the toner image 220 of the second surface 102, since heat is not sufficiently applied to the toner image 210 of the first surface 101, positive charge remains in the toner image 210 of the first surface 101 as shown in FIG. 5A.

Figure 5B:
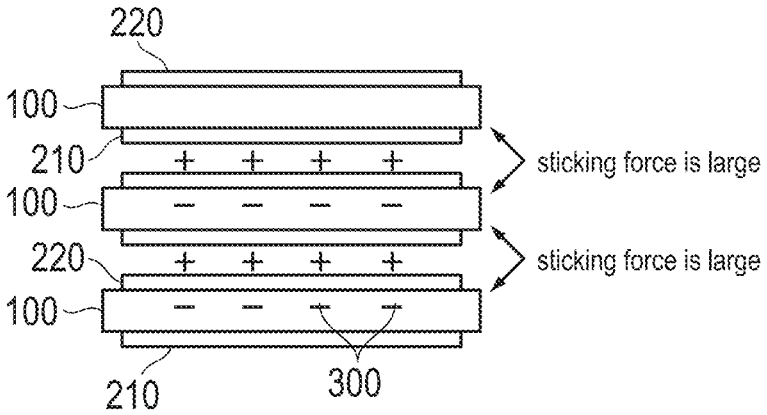
Figure 5C:
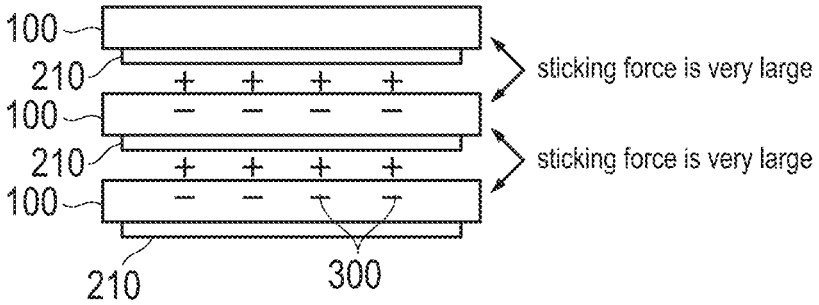
Figure 5D:
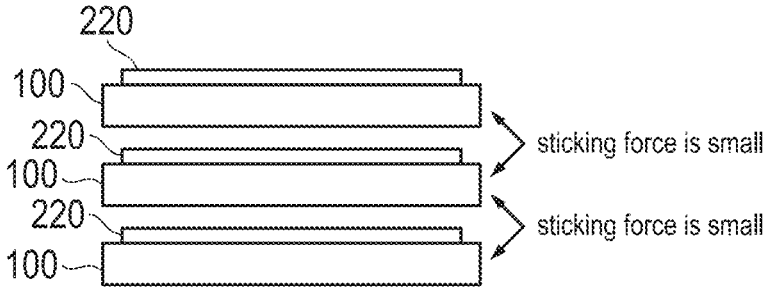

If the papers 100 with the toner image 210 of the first surface in which the positive charge has remained overlap with one another, since negative induced charge 300 is generated in the papers 100 as shown in FIG. 5B, electrostatic force in a direction to attract each other acts, so that the papers 100 are stuck with one another. Moreover, as shown in FIG. 5C, when the coverage of the second surface of the paper 100 is low, since a gap between the papers 100 becomes small and electrostatic force becomes large, sticking force of the papers 100 also becomes large. In addition, as shown in FIG. 5D, since a paper with the low coverage of a first surface is in an almost non-charged state after the fixing, the papers 100 are not stuck with one another.

Furthermore, as the number of papers stacked in the stacker apparatus 4 is large, since a gap between the papers becomes small due to their weights, electrostatic force acting between the papers becomes large. Furthermore, if the stacked papers are coated papers with small surface roughness, since a gap between the papers becomes smaller than that of plain papers, electrostatic force becomes large. In particular, adhesion of papers due to electrostatic force frequently occurs under an environment in which temperature and humidity are low.

Second Embodiment

In the first embodiment, the amount of charge to be applied to a paper has been decided in consideration of the coverages of both surfaces of the paper. However, the amount of charge to be applied to a paper may also be decided further in consideration of the coverage of another paper overlapped and the like.

Figure 6:
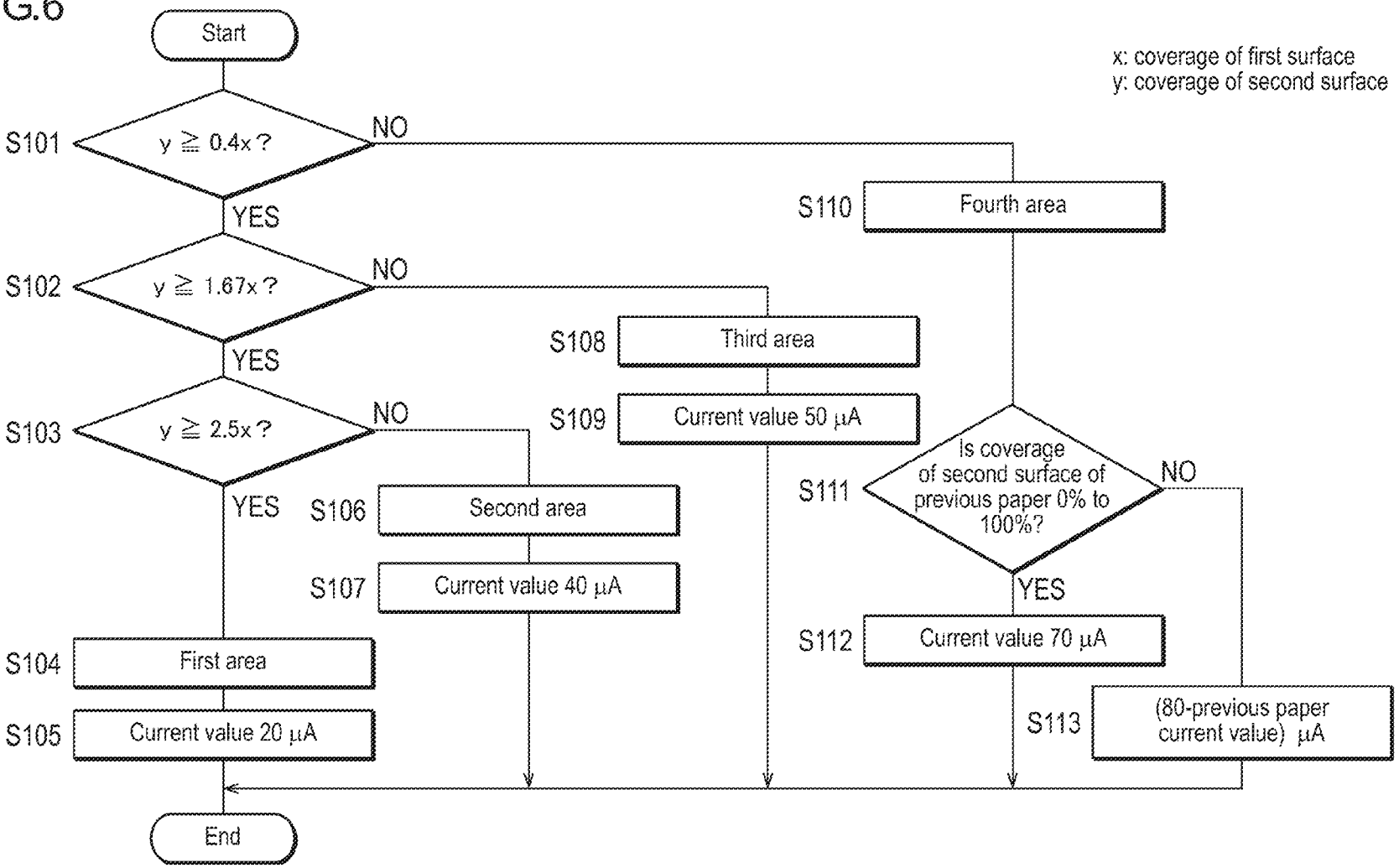
FIG. 6 is a flowchart showing the procedure of a current value decision process.

FIG. 6 is a flowchart showing the procedure of a current value decision process performed by the image forming apparatus 2. In addition, since the configuration of an image forming system 1 according to the present embodiment is similar to the configuration of the image forming system 1 according to the first embodiment except that the amount of charge to be applied to a paper is decided in consideration of the coverage of another paper and the like, a detailed description thereof will be omitted.

Firstly, a control unit 10 of an image forming apparatus 2 determines whether the coverage of a second surface of a paper is equal to or more than 0.4 times of the coverage of a first surface (step S101). In more detail, for example, the control unit 10 of the image forming apparatus 2 calculates the coverages of toner images formed on the first surface and the second surface of the paper by analyzing print data, and determines whether the coverage of the second surface is equal to or more than 0.4 times of the coverage of the first surface.

When it is determined that the coverage of the second surface is smaller than 0.4 times of the coverage of the first surface (step S101: NO), the control unit 10 proceeds to a process of step S110.

On the other hand, when it is determined that the coverage of the second surface is equal to or more than 0.4 times of the coverage of the first surface (step S101: YES), the control unit 10 determines whether the coverage of the second surface is equal to or more than 1.67 times of the coverage of the first surface (step S102). When it is determined that the coverage of the second surface is smaller than 1.67 times of the coverage of the first surface (step S102: NO), the control unit 10 proceeds to a process of step S108.

On the other hand, when it is determined that the coverage of the second surface is equal to or more than 1.67 times of the coverage of the first surface (step S102: YES), the control unit 10 determines whether the coverage of the second surface is equal to or more than 2.5 times of the coverage of the first surface (step S103).

When it is determined that the coverage of the second surface is equal to or more than 2.5 times of the coverage of the first surface (step S103: YES), the control unit 10 determines that a ratio of the coverages of the first surface and the second surface is included in a first area (see FIG. 7) (step S104). Then, the control unit 10 decides 20 μA, which is a first current value assigned to the first area in advance, as an output current value (step S105), and ends the procedure.

On the other hand, in the process shown in step S103, when it is determined that the coverage of the second surface is smaller than 2.5 times of the coverage of the first surface (step S103: NO), the control unit 10 determines that the ratio of the coverages of the first surface and the second surface is included in a second area (see FIG. 7) (step S106). Then, the control unit 10 decides 40 μA, which is a second current value assigned to the second area in advance, as the output current value (step S107), and ends the procedure.

On the other hand, in the process shown in step S102, when it is determined that the coverage of the second surface is smaller than 1.67 times of the coverage of the first surface (step S102: NO), the control unit 10 determines that the ratio of the coverages of the first surface and the second surface is included in a third area (see FIG. 7) (step S108). Then, the control unit 10 decides 50 μA, which is a third current value assigned to the third area in advance, as the output current value (step S109), and ends the procedure.

On the other hand, in the process shown in step S101, when it is determined that the coverage of the second surface is smaller than 0.4 times of the coverage of the first surface (step S101: NO), the control unit 10 determines that the ratio of the coverages of the first surface and the second surface is included in a fourth area (see FIG. 7) (step S110). Then, the control unit 10 determines whether the coverage of a second surface of a previous paper is within the range of 0% to 100% (step S111). In more detail, the control unit 10 determines whether the coverage of the second surface is within the range of 0% to 100% with respect to a paper (that is, a paper with which a current paper overlaps) passing through the voltage applying unit 80 immediately before the current paper.

When it is determined that the coverage of the second surface of the previous paper is within the range of 0% to 100% (step S111: YES), the control unit 10 decides 70 μA, which is a current value assigned in advance, as the output current value (step S112), and ends the procedure.

On the other hand, when it is determined that the coverage of the second surface of the previous paper is not within the range of 0% to 100% (step S111: NO), the control unit 10 decides, as the output current value, a value obtained by subtracting a current value of the previous paper from 80 μA (step S113), and ends the procedure. In more detail, the control unit 10 reads the output current value decided by the current value decision process with respect to the paper passing through the voltage applying unit 80 immediately before the current paper, and decides, as the output current value of the current paper, a value obtained by subtracting the read output current value from 80 μA.

Figure 7:
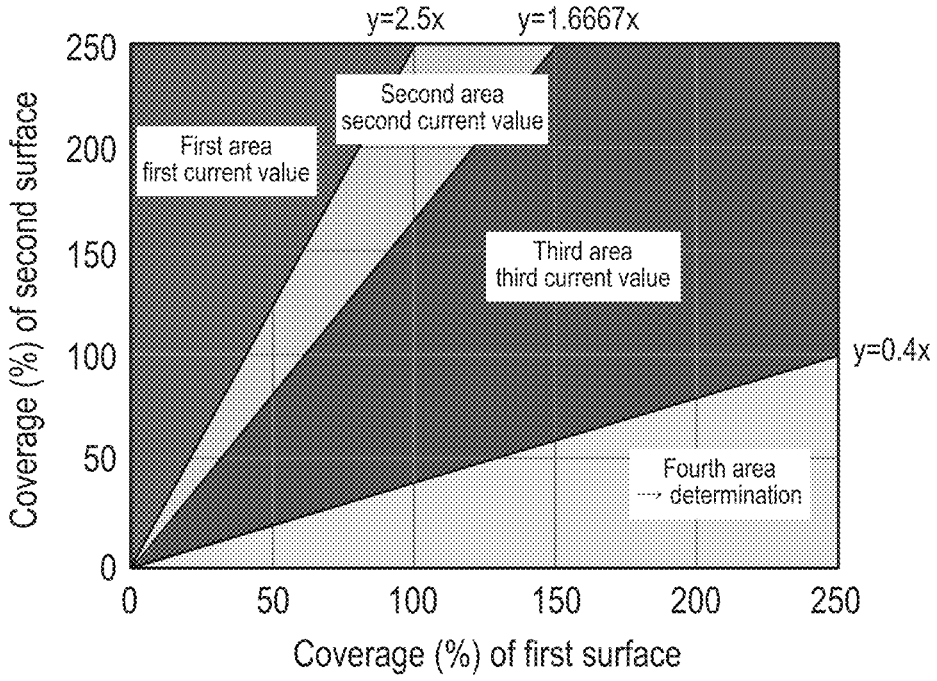
FIG. 7 is a diagram showing a relation between the coverages of both surfaces of a paper and a value of a current flowing through the paper.

FIG. 7 is a diagram showing a relation between the coverages of both surfaces of a paper and a value of a current flowing through the paper. In FIG. 7, a horizontal axis denotes the coverage of a first surface of the paper and a vertical axis denotes the coverage of a second surface.

As shown in FIG. 7, in the current value decision process, for a paper with low coverage of a first surface and high coverage of a second surface, which belongs to the first area, the first current value 20 μA is decided as an output current value. Furthermore, for papers with high coverages of both surfaces, which belong to the second area and the third area, the second current value 40 μA and the third current value 50 μA are respectively decided as output current values. Furthermore, for a paper with high coverage of a first surface and low coverage of a second surface, which belongs to the fourth area, a current value is decided in response to the coverage of an immediately previous paper. In detail, when the coverage of a second surface of the immediately previous paper is low, the current value 70 μA is decided as an output current value. On the other hand, when the coverage of the second surface of the immediately previous paper is high, a value obtained by subtracting the output current value decided for the immediately previous paper from 80 μA is decided as an output current value to be applied to a current paper. That is, the output current value is decided such that the sum of the output current value applied to the immediately previous paper and the output current value to be applied to the current paper is constant to be 80 μA.

In addition, a paper with low coverages of both surfaces is considered to be a conductor, and for example, even though a voltage subjected to constant-current control with 70 μA is applied, no charge is accumulated. Consequently, for papers around the origin of FIG. 7, an arbitrary current value can be applied as an output current value.

As described above, according to the procedure of the flowchart shown in FIG. 6, an output current value to be applied to a current paper is decided from the coverages of a first surface and a second surface of the current paper, the coverage of a second surface of an immediately previous paper, and an output current value applied to the immediately previous paper.

Furthermore, the voltage applying unit 80 applies a voltage subjected to constant-current control with the output current value decided by the control unit 10 to the paper 100. The voltage subjected to constant-current control is applied to the paper, so that charge on the surface of the paper 100 is adjusted and adhesion of papers is prevented. Hereinafter, with reference to FIGS. 8A to 8F, the effect of the charge adjustment process according to the present embodiment will be described in detail.

Figure 8A:
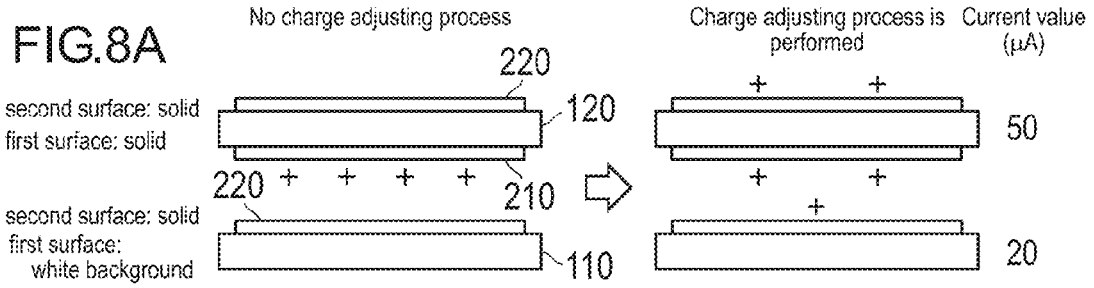
FIGS. 8A to 8F are diagrams for explaining an effect of a charge adjustment process by a voltage applying unit.
Figure 8B:
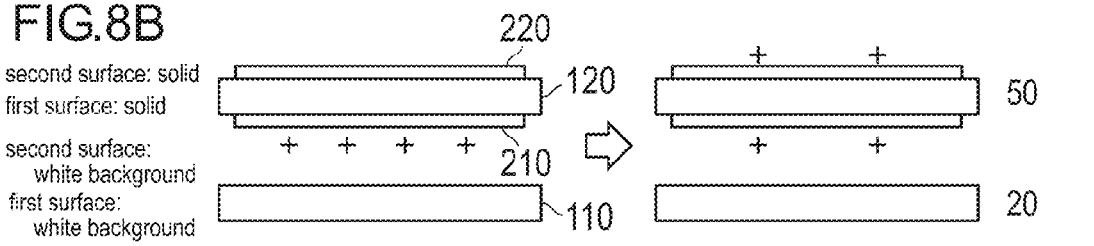
Figure 8C:
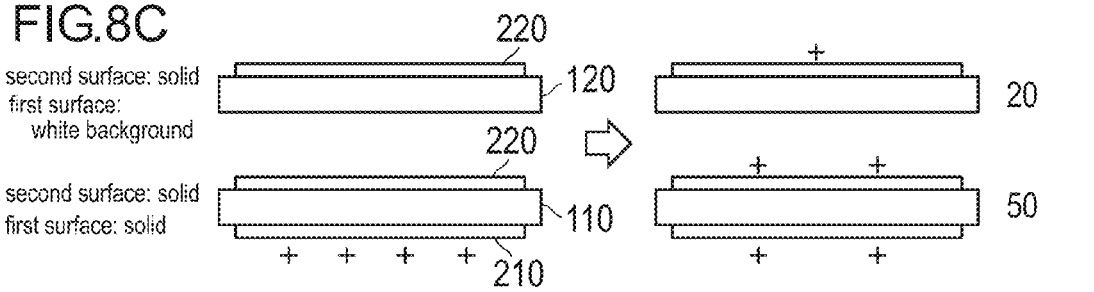
Figure 8D:
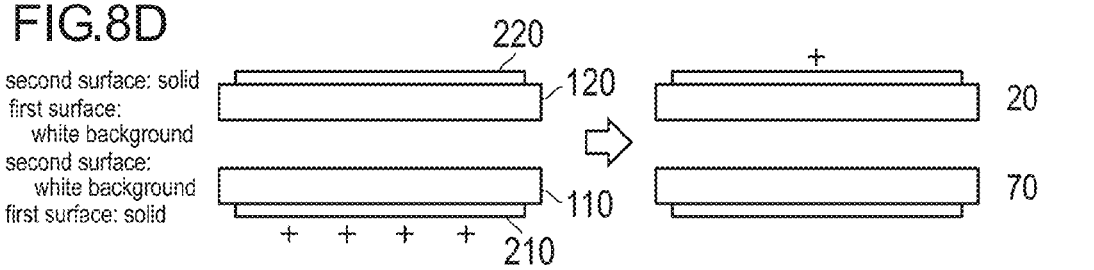
Figure 8E:
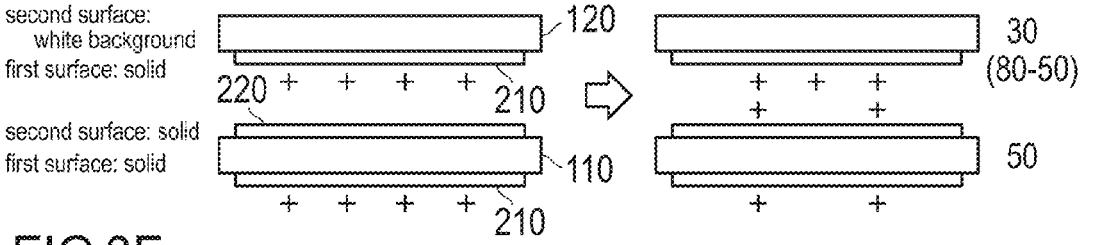
Figure 8F:
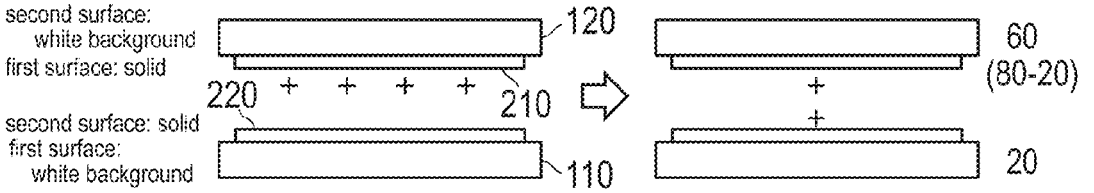

FIG. 8A is a diagram for explaining the effect of the charge adjustment process when a paper 120 with high coverages of both surfaces overlaps with a paper 110 with low coverage of a first surface and high coverage of a second surface. The right side of FIG. 8A is a diagram showing the charged states of the papers 110 and 120 after the charge adjustment process, and the left side is a diagram showing the charged states of the papers 110 and 120 before the charge adjustment process as a comparison example.

In this case, the control unit 10 of the image forming apparatus 2 performs the aforementioned current value decision process, thereby deciding an output current value 20 μA with respect to the paper 110 with the low coverage of the first surface and the high coverage of the second surface and deciding an output current value 50 μA with respect to the paper 120 with the high coverages of both surfaces.

Furthermore, the voltage applying unit 80 applies a voltage subjected to constant-current control with 20 μA to the paper 110 and applies a voltage subjected to constant-current control with 50 μA to the paper 120. As a consequence, in the paper 110, charge with a very small amount is accumulated in a toner image 220 of a second surface, and in the paper 120, charge with an amount corresponding to about ½ before the charge adjustment process is accumulated in the toner images 210 and 220 of both surfaces.

Consequently, according to the charge adjustment process of the present embodiment, electrostatic force in a direction to repel each other acts between the papers 110 and 120, so that the papers 110 and 120 are actively separated from each other.

Furthermore, as shown in FIGS. 8B to 8F, according to the charge adjustment process of the present embodiment, a voltage subjected to constant-current control with a current value decided by the current value decision process is applied to papers, so that charge existing on the surfaces of the papers 110 and 120 is adjusted and adhesion of the papers is prevented. In addition, in FIG. 8E and FIG. 8F, since an output current value to be applied to the paper 120 is decided in consideration of the coverage of the second surface of the paper 110 and the output current value to be applied to the paper 110 in addition to the coverages of both surfaces of the paper 120, the papers are actively separated from each other as compared with FIG. 4F and FIG. 4G in which these factors are not considered.

As described above, according to the charge adjustment process of the present embodiment, the amount of charge existing on two facing surfaces of the two papers 110 and 120 overlapping with each other is appropriately adjusted, so that the papers are reliably prevented from being stuck by electrostatic force.

In addition, in the procedure of the flowchart shown in FIG. 6, the process shown in step S111 can be omitted. In this case, when it is determined that the ratio of the coverages of the first surface and the second surface is included in the fourth area, the current value 70 μA is uniformly decided as an output current value for example.

Furthermore, in the process shown in step S113 of FIG. 6, when it is determined that the coverage of the second surface of the immediately previous paper is not within the range of 0% to 100%, a value obtained by subtracting the output current value of the immediately previous paper from 80 μA has been decided as the output current value of the current paper. However, when the coverage of the second surface of the immediately previous paper is not within the range of 0% to 100%, a current value 45 μA may also be uniformly decided as the output current value of the current paper for example, regardless of the output current value of the immediately previous paper.

Figure 9:
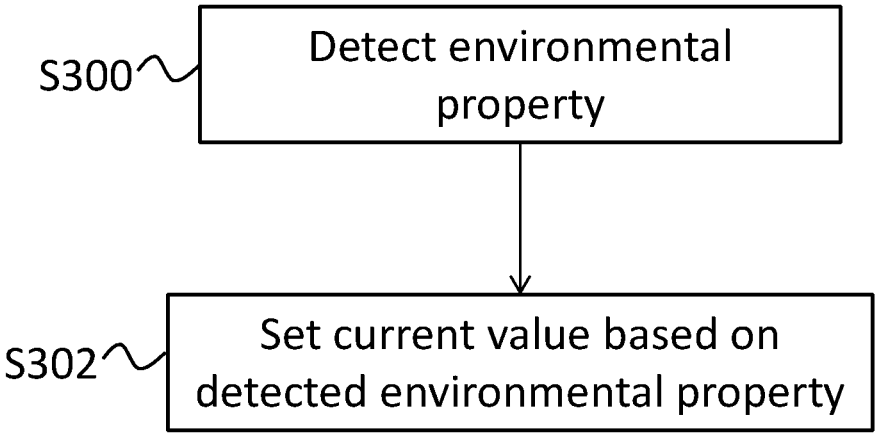
FIG. 9 is a flowchart showing the procedure of a current value decision process according to at least an embodiment.
Figure 10:
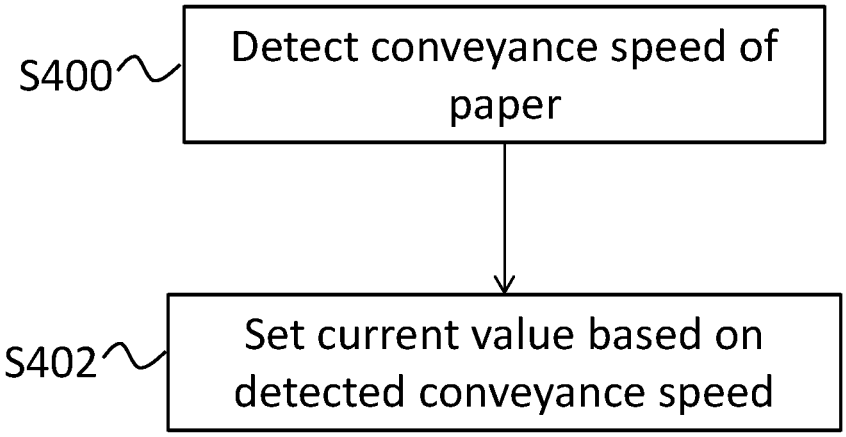
FIG. 10 is a flowchart showing the procedure of a current value decision process according to at least an embodiment.
Figure 11:
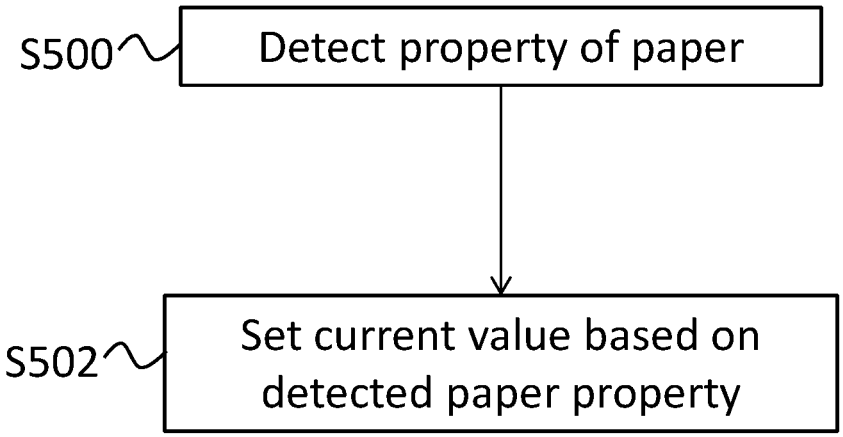
FIG. 11 is a flowchart showing the procedure of a current value decision process according to at least an embodiment.

Furthermore, the current value decided by the aforementioned current value decision process can be appropriately changed in response to the surrounding environment of the image forming apparatus 2, the conveyance speed of a paper, the type of the paper, the basis weight and/or the size of the paper, and the like. For example, as seen in FIG. 9, an environmental property may be detected (S300), and then the current value may be set based on the detected environmental property (S302). Alternatively, as seen in FIG. 10, a conveyance speed may be detected (S400), and then the current value may be set based on the detected conveyance speed (S402). For example, the current value can be changed to a large value as the ambient temperature and humidity of an installation place of the image forming apparatus 2 are high, and can be changed to a large value as the conveyance speed of the paper is fast. Additionally, as seen in FIG. 11, a property of the paper may be detected (S500), and then the current value may be set based on the detected paper property (S502). For example, the current value can be changed to a large value as the surface roughness of the paper is fine as with a coated paper, and can be changed to a large value as the basis weight and/or the size of the paper are large. In this case, for example, a conversion table is created by associating the parameters such as the surrounding environment, the conveyance speed of the paper, the type of the paper, and the basis weight and/or the size of the paper with the current values assigned in the aforementioned first to fourth areas, and a current value to be applied to each area is decided from each parameter value.

The present invention is not limited only to the aforementioned embodiments, and can be variously modified within the scope of the appended claims.

For example, in the aforementioned embodiments, the control unit of the image forming apparatus serves as a decision unit that decides the amount of charge to be applied to a paper from the coverages of both surfaces of the paper. However, a control unit may be provided in the charge adjusting apparatus and the control unit of the charge adjusting apparatus may also serve as the aforementioned decision unit. In this case, the control unit of the charge adjusting apparatus communicates with the control unit of the image forming apparatus and acquires information on the coverages of each paper.

Furthermore, in the aforementioned embodiments, the voltage applying unit is subjected to constant-current control. However, the control method of the voltage applying unit is not limited to the constant-current control and the voltage applying unit, for example, may also be subjected to constant-voltage control.

Furthermore, in the aforementioned embodiments, a voltage is applied to a paper by a pair of conductive rubber rollers arranged to face to each other, so that charge is applied to the paper. However, the voltage applying unit that applies charge by applying a voltage to a paper is not limited to the pair of conductive rubber rollers and may also be a sawtooth electrode or a charger.

Furthermore, in the aforementioned embodiments, the image forming system having the image forming apparatus and the charge adjusting apparatus has been described as an example. However, the charge adjusting apparatus may also be integrally formed with the image forming apparatus. In this case, the voltage applying unit is provided in the image forming apparatus.

A units and a method for performing various processes in the image forming system according to the aforementioned embodiments can also be realized by any one of a dedicated hardware circuit and a programmed computer. The aforementioned program, for example, may also be provided by a computer-readable recording medium such as a flexible disk and CD-ROM (Compact Disc Read Only Memory), or may also be provided on-line via a network such as the Internet. In this case, the program recorded on the computer-readable recording medium is typically transmitted to and stored in a storage unit such as a hard disk. Furthermore, the aforementioned program may also be provided as single application software, or may also be incorporated in software of the image forming system as one function of the image forming system.

What is claimed is:

1. An image forming system having an image forming apparatus and a charge adjusting apparatus, comprising:

a decision unit configured to decide an amount of charge to be applied to a recording sheet from coverages of toner images of both surfaces of the recording sheet, wherein the image forming apparatus comprises:

a fixing unit configured to heat and press a recording sheet to which a toner image is transferred, thereby fixing the toner image to the recording sheet, and the charge adjusting apparatus comprises:

a voltage applying unit configured to apply a voltage to the recording sheet to which the toner image is fixed by the fixing unit, thereby applying charge with the amount decided by the decision unit to the recording sheet;

one recording sheet with a fixed toner image overlaps with another recording sheet with a fixed toner image, and the decision unit decides an amount of charge to be applied to the one recording sheet from coverages of both surfaces of the one recording sheet and a coverage of a surface of the another recording sheet, which faces the one recording sheet.

2. The image forming system as claimed in claim 1, wherein the decision unit decides the amount of charge to be applied to the one recording sheet from the coverages of both surfaces of the one recording sheet, the coverage of the facing surface of the another recording sheet, and an amount of charge to be applied to the another recording sheet by the voltage applying unit.

3. The image forming system as claimed in claim 1, wherein the voltage applying unit applies the voltage subjected to constant-current control to the recording sheet, and the decision unit decides a current value of the constant-current control as the amount of charge to be applied to the recording sheet.

4. The image forming system as claimed in claim 1, wherein the recording sheet is conveyed in a horizontal direction, and the voltage applying unit applies the voltage to an upper surface of the recording sheet conveyed in the horizontal direction.

5. The image forming system as claimed in claim 1, wherein the amount of charge to be applied to the recording sheet is changed in response to a surrounding environment of a place where the image forming apparatus has been installed.

6. The image forming system as claimed in claim 1, wherein the amount of charge to be applied to the recording sheet per unit time is changed in response to a conveyance speed of the recording sheet.

7. The image forming system as claimed in claim 1, wherein the amount of charge to be applied to the recording sheet is changed in response to a type of the recording sheet.

8. An image forming system having an image forming apparatus and a charge adjusting apparatus, comprising:

a decision unit configured to decide an amount of charge to be applied to a recording sheet from coverages of toner images of both surfaces of the recording sheet, wherein the image forming apparatus comprises:

a fixing unit configured to heat and press a recording sheet to which a toner image is transferred, thereby fixing the toner image to the recording sheet, and the charge adjusting apparatus comprises:

a voltage applying unit configured to apply a voltage to the recording sheet to which the toner image is fixed by the fixing unit, thereby applying charge with the amount decided by the decision unit to the recording sheet;

the amount of charge to be applied to the recording sheet is changed in response to at least one of a basis weight and a size of the recording sheet.

9. An image forming method comprising:

(a) deciding an amount of charge to be applied to a recording sheet from coverages of toner images of both surfaces of the recording sheet;

(b) heating and pressing a recording sheet to which a toner image is transferred, thereby fixing the toner image to the recording sheet; and (c) applying a voltage to the recording sheet to which the toner image is fixed in the step (b), thereby applying charge with the amount decided in the step (a) to the recording sheet;

wherein one recording sheet with a fixed toner image overlaps with another recording sheet with a fixed toner image, and in the step (a), an amount of charge to be applied to the one recording sheet is decided from coverages of both surfaces of the one recording sheet and a coverage of a surface of the another recording sheet, which faces the one recording sheet.

10. The image forming method as claimed in claim 9, wherein in the step (a), the amount of charge to be applied to the one recording sheet is decided from the coverages of both surfaces of the one recording sheet, the coverage of the facing surface of the another recording sheet, and an amount of charge to be applied to the another recording sheet.

11. The image forming method as claimed in claim 9, wherein in the step (c), the voltage subjected to constant-current control is applied to the recording sheet, and in the step (a), a current value of the constant-current control is decided as the amount of charge to be applied to the recording sheet.

12. The image forming method as claimed in claim 9, wherein the recording sheet is conveyed in a horizontal direction, and in the step (c), the voltage is applied to an upper surface of the recording sheet conveyed in the horizontal direction.

13. The image forming method as claimed in claim 9, wherein the amount of charge to be applied to the recording sheet is changed in response to a surrounding environment.

14. The image forming method as claimed in claim 9, wherein the amount of charge to be applied to the recording sheet per unit time is changed in response to a conveyance speed of the recording sheet.

15. The image forming method as claimed in claim 9, wherein the amount of charge to be applied to the recording sheet is changed in response to a type of the recording sheet.

16. An image forming method comprising the steps of:

(a) deciding an amount of charge to be applied to a recording sheet from coverages of toner images of both surfaces of the recording sheet;

(b) heating and pressing a recording sheet to which a toner image is transferred, thereby fixing the toner image to the recording sheet; and (c) applying a voltage to the recording sheet to which the toner image is fixed in the step (b), thereby applying charge with the amount decided in the step (a) to the recording sheet;

wherein the amount of charge to be applied to the recording sheet is changed in response to at least one of a basis weight and a size of the recording sheet.

17. A charge adjusting apparatus comprising:

a voltage applying unit configured to apply a voltage to a recording sheet to which a toner image is fixed, thereby applying charge with an amount, which is decided from coverages of toner images of both surfaces of the recording sheet, to the recording sheet;

wherein one recording sheet with a fixed toner image overlaps with another recording sheet with a fixed toner image, and an amount of charge to be applied to the one recording sheet is decided from coverages of both surfaces of the one recording sheet and a coverage of a surface of the another recording sheet, which faces the one recording sheet.

18. The charge adjusting apparatus as claimed in claim 17, wherein the amount of charge to be applied to the one recording sheet is decided from the coverages of both surfaces of the one recording sheet, the coverage of the facing surface of the another recording sheet, and an amount of charge to be applied to the another recording sheet by the voltage applying unit.

19. The charge adjusting apparatus as claimed in claim 17, wherein the voltage applying unit applies the voltage subjected to constant-current control to the recording sheet, and a current value of the constant-current control is decided as the amount of charge to be applied to the recording sheet.

20. The charge adjusting apparatus as claimed in claim 17, wherein the recording sheet is conveyed in a horizontal direction, and the voltage applying unit applies the voltage to an upper surface of the recording sheet conveyed in the horizontal direction.

21. The charge adjusting apparatus as claimed in claim 17, wherein the amount of charge to be applied to the recording sheet is changed in response to a surrounding environment of a place where the charge adjusting apparatus has been installed.

22. The charge adjusting apparatus as claimed in claim 17, wherein the amount of charge to be applied to the recording sheet per unit time is changed in response to a conveyance speed of the recording sheet.

23. The charge adjusting apparatus as claimed in claim 17, wherein the amount of charge to be applied to the recording sheet is changed in response to a type of the recording sheet.

24. A charge adjusting apparatus comprising:

a voltage applying unit configured to apply a voltage to a recording sheet to which a toner image is fixed, thereby applying charge with an amount, which is decided from coverages of toner images of both surfaces of the recording sheet, to the recording sheet;

wherein the amount of charge to be applied to the recording sheet is changed in response to at least one of a basis weight and a size of the recording sheet.

* * * * *